United States Patent [19]

Benson et al.

[11] Patent Number: 4,487,353

[45] Date of Patent: Dec. 11, 1984

[54] POWDER ACTUATED TOOL

[75] Inventors: John Benson, Sherwood; Harold L. Hanel; Douglas A. Freeman, both of Portland, all of Oreg.

[73] Assignee: International Telephone and Telegraph Corporation, New York, N.Y.

[21] Appl. No.: 322,569

[22] Filed: Nov. 18, 1981

[51] Int. Cl.[3] ..... B25C 1/14

[52] U.S. Cl. ..... 227/9

[58] Field of Search ..... 227/8, 9, 10, 11

[56] References Cited

U.S. PATENT DOCUMENTS

| | | | |
|---|---|---|---|
| 2,997,325 | 8/1961 | Peterson | 213/1 X |
| 3,168,744 | 2/1965 | Kvavle | 227/10 |
| 3,181,760 | 5/1965 | Catlin et al. | 227/10 |
| 3,363,817 | 1/1968 | Brack | 227/9 |
| 3,380,552 | 4/1968 | Peterson | 188/1 |
| 3,398,812 | 8/1968 | Peterson | 188/1 |
| 3,415,438 | 12/1968 | De Caro | 227/10 |
| 3,490,673 | 1/1970 | Diehl | 227/10 |
| 3,552,625 | 1/1971 | Udert | 227/10 |
| 3,554,425 | 1/1971 | Oesterle | 227/10 |
| 3,565,313 | 2/1971 | Seghezzi et al. | 227/10 |
| 3,566,975 | 3/1971 | Udert | 227/10 X |
| 3,679,118 | 7/1972 | Maier et al. | 227/10 |
| 3,743,159 | 7/1973 | Schneider | 227/10 |
| 3,786,977 | 1/1974 | Shamaly | 227/10 X |
| 3,910,477 | 10/1975 | Kavan | 227/10 |
| 4,019,824 | 4/1977 | Percy | 403/261 |
| 4,025,029 | 5/1977 | Kotas et al. | 227/10 |
| 4,063,672 | 12/1977 | Jochum | 227/10 |
| 4,068,790 | 1/1978 | Osterle et al. | 227/10 X |
| 4,074,843 | 2/1978 | Oesterle | 227/8 |
| 4,126,335 | 11/1978 | Voss | 285/39 |
| 4,134,527 | 1/1979 | Termet | 227/10 |
| 4,162,033 | 7/1979 | Pomeroy | 227/10 |
| 4,189,081 | 2/1980 | Combette et al. | 227/10 |
| 4,201,324 | 5/1980 | Maier et al. | 227/9 |
| 4,252,259 | 2/1981 | Brosius | 227/10 X |
| 4,332,340 | 6/1982 | Harris | 227/10 |

*Primary Examiner*—Paul A. Bell

*Attorney, Agent, or Firm*—James B. Raden; William J. Michals

[57] ABSTRACT

A tool for driving nails into hard surfaces wherein the driving power is provided by cartridges of explosive powder. An extrudible stop member is provided in the barrel of the tool in front of the piston which is impacted by the piston when the tool is overdriven. The stop member extrudes through a passage to the front of the barrel if repeated overdriving of the piston occurs thereby providing a visual indication of such condition existing. In addition, a novel clamping arrangement is disclosed for retaining the return dog for the piston in the barrel housing.

6 Claims, 4 Drawing Figures

POWDER ACTUATED TOOL

BACKGROUND OF THE INVENTION

The present invention relates generally to a powder actuated tool and, more specifically, to such a tool having means for indicating an overdriven condition of the tool and a novel clamp arrangement for the return dog for the tool.

A powder actuated tool of the type to which the present invention relates is designed to accept a nail at the forward end of the barrel and a cartridge at the breech end of the barrel. The tool is pressed against a work surface to release a safety mechanism and then fired. Tools of this type are disclosed in the following U.S. Pat. Nos. 3,066,302 to De Caro et al.; 3,494,125 to Robinson; 3,678,808 to Hsu et al. and 4,114,792 to Pomeroy.

As explained in the aforementioned Hsu et al. patent, it is desirable to provide in a tool of the type hereinabove described means for absorbing the energy of the piston to avoid bending or other damage occurring to the piston when the piston is overdriven. Overdrive of the piston occurs when the nail is driven into a relatively soft material. In the Hsu et al. patent, the aforementioned problem is solved by forming a tapered portion of the piston of a relatively softer metal than that of a stop member in the barrel which it engages so that when the piston is overdriven, energy is dissipated by extruding of the softer tapered portion of the piston. While this arrangement is generally satisfactory, it provides no indication to the operator that overdriving of the piston has occurred and, therefore, that replacement of the piston might be required. In another tool, a collapsible metal ring is utilized as the stop member which, when impacted by the piston during overdrive, is partially collapsed, but does not extrude or provide any indication of overdriving occurring. It is one object of the present invention to provide means for visually indicating that repeated overdriving of the piston of the tool has occurred.

In powder actuated tools of the type contemplated herein, a return dog is mounted in the wall of the barrel housing and extends through an elongated guide slot in the barrel which is slidable in the housing. The return dog serves to limit forward movement of the piston in the barrel when the barrel is thrown forwardly in the barrel housing to ready the tool for firing. The return dog is removable from the barrel housing to permit replacement of the barrel or piston therein when required. In the tool disclosed in the aforementioned De Caro et al. patent, the return dog is in the form of a plug threaded into an opening in the wall of the barrel housing. During continued use of the tool, the dog may unthread in its corresponding opening in the barrel housing causing it to loosen, potentially rendering the tool unsafe. The aforementioned Robinson and Pomeroy patents each discloses a return dog which is mounted on the barrel housing and spring biased into its inward blocking position. This arrangement is more reliable than a threaded plug but is relatively time consuming to disassemble to allow removal of the barrel and piston from the barrel housing of the tool when maintenance or repair is required. It is, therefore, another object of the present invention to provide a novel clamping means for the return dog of the tool which is reliable yet easy to disengage for removal of the dog from the barrel housing.

SUMMARY OF THE INVENTION

According to one aspect of the present invention, an extrudible stop member is provided in the barrel of the tool in front of the piston which is impacted by the piston if the piston is overdriven. A passage extends from the channel in which the extrudible stop member is located to the front of the barrel of the tool so that if repeated overdrive of the piston occurs, the material of the stop member will extrude through the passage to the front of the tool providing a visual warning indication of overdriving having occurred.

According to another aspect of the invention, there is provided a unique return dog for the tool and means for retaining the return dog in the barrel housing. The return dog is normally mounted forwardly in a slot in the barrel housing. The dog embodies a forwardly opening notch into which a portion of the barrel housing extends to positively retain the dog therein. When the dog is shifted to a rearward position in the slot in the barrel housing, it may be removed therefrom. The retention means for the dog comprises an annular groove in the outer surface of the housing behind the dog when the dog is in its forward position. A pair of semi-cylindrical clamping segments are positioned in the groove. One of the segments has an axial cutout therein opening at its forward edge receiving the dog. A releasable spring holds the segments in the groove, thereby retaining the dog in its forward, locked-in-position in the barrel housing.

DESCRIPTION OF THE PREFERRED EMBODIMENT

Figures 1, 4:
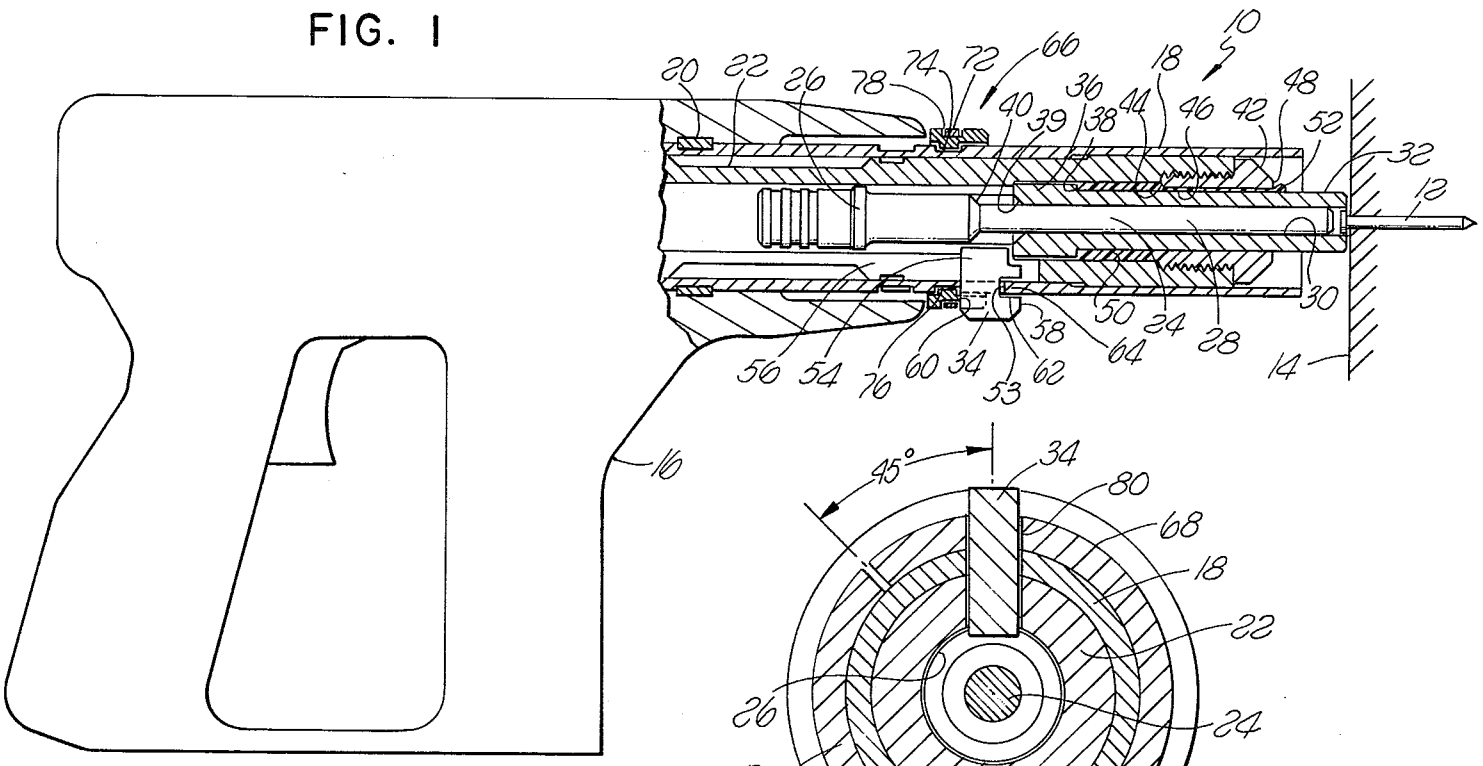
FIG. 1 is a side elevational view of the tool of the present invention with the forward barrel portion thereof shown in partial longitudinal section.
FIG. 4 is a transverse sectional view taken along line 4—4 of FIG. 3.

Referring now to the drawings in detail, the tool 10 illustrated is designed to drive a nail 12 into a hard surface 14, such as concrete. The tool includes a handle housing 16, a barrel housing 18 fixed in the handle housing by a retaining ring 20, a barrel 22 slidable in the barrel housing and a captive piston 24 slidable in the barrel. The piston embodies a relatively large diameter rear head 26 which is slidable in the barrel, and a foward smaller diameter shank 28 which slides within an axial bore 30 in a barrel extension 32 mounted in the forward end of the barrel. The piston is adapted to be driven by an explosive cartridge in the breech block (not shown) of the tool.

A return dog is mounted in the barrel housing in front of the head 26 of the piston. The return dog serves to block forward movement of the piston when the barrel is thrown forwardly in the barrel housing when preparing the tool for firing. When the barrel is thrown to its forward position, the piston, being blocked by the return dog, becomes located in the rear portion of the barrel so that the nail 12 may be inserted into the barrel extension 32. The tool is then pushed against the work surface 14 pushing the barrel of the tool rearwardly so that the rearward end of the barrel engages the breech block in the handle housing conditioning the tool for firing. When the operator pulls the trigger of the tool, the firing pin in the tool is propelled against an explosive cartridge in the breech block causing the piston to be driven forwardly in the barrel thereby driving the nail 12 into the work surface, whereupon the piston will assume the position illustrated in FIG. 1 of the drawings.

The structure generally described above is typical of tools widely used in the industry and further explanation of that structure is not deemed necessary. Reference may be had to any one of the foregoing four patents identified hereinabove for a more complete description of the firing mechanism of the tool and its operation. The improvement of the present invention resides in the stop member utilized for absorbing energy upon overdriving of the piston, which occurs when the work surface 14 is of a relatively soft material, and in the return dog and the means for retaining the dog in the barrel housing.

The novel stop member arrangement of the present invention is illustrated in FIG. 1. As seen therein, the barrel extension 32 has a rear outwardly extending annular flange 36 providing a forwardly facing annular surface 38. A tapered surface 39 is provided on the rear of the flange which leads into the bore 30. The surface 39 matches a forwardly facing tapered shoulder 40 which provides a transition between the shank 28 and head 26 of the piston. A nose plug 42 is threaded into the forward end of the barrel. The nose plug closely surrounds the barrel extension 32 thus forming an inwardly extending annular flange at the forward end of the barrel 22. A rearwardly facing tapered stop shoulder 44 is formed on the rear of the nose plug. An axially extending passage 46 extends from the shoulder 44 to the front 48 of the plug for a purpose which will be seen later. Such passage may be provided by forming an axial groove in the inner surface of the plug.

An extrudible stop member 50 is positioned in the annular channel defined between the shoulders 38 and 44, and the inner surface of the barrel 22 and outer surface of the barrel extension 32. The stop member is preferably in the form of a plastic sleeve. A suitable material for the sleeve is UHMW polyethylene sold by Cadillac Plastic and Chemical Company of Detroit, Mich. Such plastic is a high density material which serves as a shock absorber for dissipating the energy caused by overdriving of the piston. More specifically, when overdrive of the piston occurs, the shoulder 40 on the piston will engage the rear surface 39 of the barrel extension, thus forcing the surface 38 of the extension against the rear of the plastic sleeve 50, thereby axially impacting the sleeve. If repeated overdrive of the piston occurs, some of the plastic of the sleeve 50 will extrude through the passage 46 to the front of the nose plug forming a bead 52. Preferably the plastic is formed of a relatively bright color. The UHMW polyethylene mentioned above is yellow. Thus, when repeated overdriving of the piston occurs, eventually a yellow bead will appear at the forward end of the barrel of the tool which provides a visual warning indication of overdriving having occurred so that the operator will know that it is time to disassemble the tool to inspect the piston and other internal parts to see whether they may be damaged and require replacement.

Turning now to the second feature of the invention involving the return dog 34 and clamping mechanism therefor, the return dog is mounted in an axially extending relatively short slot 53 formed in the wall of the barrel housing 18 just in front of the handle housing 16. The inner portion 54 of the return dog extends into an elongated axially extending guide slot 56 formed in the barrel 22 parallel to and in alignment with the slot 53. As best seen in FIG. 1, the inner portion 54 of the dog extends to a point in front of the head 26 of the piston for limiting forward movement of the piston relative to the barrel. The distance between the forward edge 58 and rear edge 60 of the dog is less than the length of the slot 53 so that the dog may be removed from the slot 53 when the dog is in a rearward position in the slot. A notch 62 is cut in the forward portion of the dog opening at the forward edge 58 thereof. As shown in FIG. 1, the dog is in its forward position wherein the notch receives the section 64 of the wall of the barrel housing immediately in front of the slot 53 providing an interlock between the barrel housing and the return dog. A clamping assembly, generally designated 66, is positioned on the barrel housing behind the return dog for retaining the dog in its forward position illustrated in FIG. 1 so that the dog cannot be removed from the barrel housing.

Figure 2:
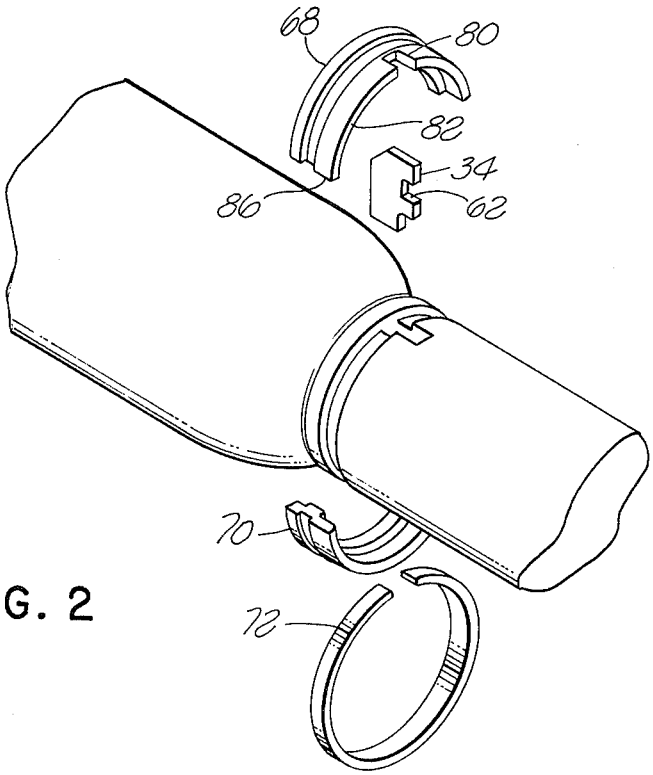
FIG. 2 is an exploded perspective view showing the underside of the tool and the return dog clamping arrangement therefor.
Figure 3:
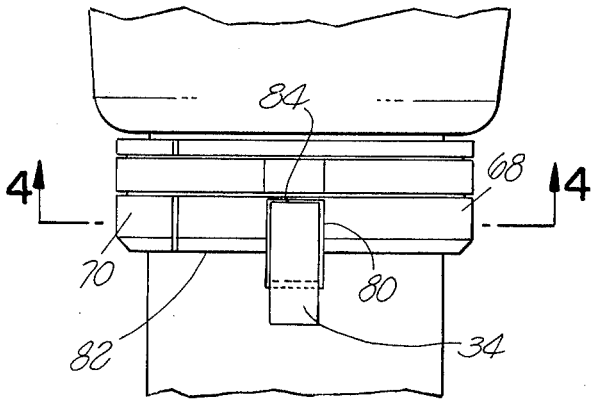
FIG. 3 is a fragmentary bottom view of the tool showing the return dog clamping assembly fully installed.

As best seen in FIG. 2, the clamping assembly includes two semi-cylindrical clamping segments 68 and 70 and a C-spring 72. As seen in FIG. 1, an annular groove 74 is formed in the outer surface of the barrel housing behind the rear edge 60 of the return dog. The clamping segments 68 and 70 when assembled together provide a clamping ring which surrounds the barrel housing. The ring is formed with an inwardly extending annular flange 76 which is located in the groove 74 for axially retaining the segments 68 and 70 on the barrel housing. An annular channel 78 is formed in the outer surface of the clamping ring formed by the segments 68 and 70. The channel receives the C-spring 72 which retains the segments in the groove 76. An axial cutout 80 is formed in the clamping segment 68 opening at the forward edge 82 thereof. The cutout 80 is dimensioned to receive the rear portion of the return dog 34 as best seen in FIG. 3. The bottom 84 of the cutout 80 is immediately adjacent to the rear edge 60 of the return dog thereby retaining the return dog in its forward position illustrated in FIG. 1. The return dog is positively retained in the barrel housing by the interlock afforded by the housing wall 64 extending into the notch 62 in the dog. The C-spring 72 is mounted in the groove 78 in the clamping ring so that its ends are positioned on opposite sides of the return dog, as seen in FIG. 3, so that the ring cannot rotate in the groove 78. This assures that a portion of the ring will always overlie the abutting ends of the clamping segments 68 and 70. We have found that the position of the return dog 34 and the C-spring 72 relative to the butting ends of the clamping segments 68 and 70 is critical in order to prevent the clamping assembly from breaking apart due to high pressures being developed within the barrel upon firing of the tool. We have found that breaking apart of the clamping assembly is prevented by positioning the axial cutout 80 in the clamping segment 68 between 30 to 60 degrees from the end 86 of the segment and preferably at 45 degrees as shown in FIG. 4.

From the foregoing, it will be appreciated that the clamping assembly 66 of the invention retains the return dog 34 in a forward position so that a positive interlock is provided between the return dog and the barrel housing. Due to the position of the return dog and thus the ends of the C-spring 72 relative to the abutting ends of the semi-cylindrical segments 68 and 70, the clamping arrangement will not disengage even when high pressures are developed within the barrel when the tool is fired. The return dog may be removed for disassembly of the forward portion of the tool by inserting the end of a suitable flat tool, such as a screw driver, under one end of the C-spring to radially expand the spring out of the groove 78 thus allowing the spring to be pushed forwardly over the forward ends of the clamping segments 68 and 70. With the spring removed, the clamping segments may be removed from the groove 74 in the barrel housing thus allowing the return dog 34 to be pushed rearwardly in the slot 52 so that it can then be removed radially outwardly through the slot. Then the barrel and piston may be removed from the barrel housing from the forward end of the housing.

What is claimed is:

1. A tool for explosively driving an elongated fastener into a work surface comprising:

a housing having a barrel therein formed with an inwardly extending annular flange adjacent to its forward end providing a central opening with a rearwardly facing shoulder around said opening;

a captive piston in said barrel;

said piston having a rear head portion slidable in said barrel and a forward shank of a diameter less than that of said head portion providing a forwardly facing shoulder therebetween;

an extrudible stop member in said barrel located between said shoulders adapted to be impacted in response to movement of said piston shoulder when the tool is fired;

means defining a passage extending from said rearwardly facing shoulder to the front of said flange whereby, if repeated overdrive of the piston occurs, said stop member will extrude through said passage to the front of said flange providing a visual indication of overdriving having occurred; and, a barrel extension is slidably mounted in the forward end of said barrel having an axial bore therethrough slidably receiving said piston shank;

said extension having a rear, outwardly extending flange providing front and rear surfaces;

said front surface engaging the rear of said stop member and said rear surface being engageable by said forwardly facing shoulder on said piston; and said passage being formed between said barrel flange and said extension.

2. A tool as set forth in claim 1 wherein:

said stop member is formed of a plastic.

3. A tool as set forth in claim 1 wherein:

said stop member is formed of a relatively bright colored material.

4. A tool as set forth in claim 1 including:

a nose plug threaded into the forward end of said barrel providing said barrel flange, said nose plug releasably retaining said piston, said stop member and said extension in said barrel.

5. A tool for explosively driving an elongated fastener into a work surface comprising:

a housing having a barrel therein containing a slidable extension at its forward end, said extension having an axial bore therein;

a captive piston in said barrel;

said piston having a rear head slidable in said barrel and a forward shank of a diameter less than that of said head providing a forwardly facing shoulder therebetween, said shank being slidable in said extension bore;

said extension having a rear, outwardly extending flange providing front and rear surfaces;

said barrel having an inwardly extending annular flange adjacent to said forward end surrounding said extension and providing a rearwardly facing shoulder, said shoulder being spaced forwardly of said front surface defining an annular channel therebetween;

an extrudible stop member in said channel and adapted to be deformed if overdrive of the piston occurs; and, a passage between said channel and the front of said flange through which said stop member will extrude if repeated overdrive of the piston occurs thereby providing at the front of said barrel a visual indication of overdriving having occurred.

6. A tool as set forth in claim 5 including:

a nose plug threaded into said forward end of said barrel over said extension providing said barrel flange, said nose plug releasably retaining said piston, said stop member and said extension in said barrel.

* * * * *